United States Patent [19]

Hintsch

[11] Patent Number: 4,669,513

[45] Date of Patent: Jun. 2, 1987

[54] GUIDE FOR A PICKING ELEMENT IN A WEAVING MACHINE

[75] Inventor: Otto Hintsch, Wallisellen, Switzerland

[73] Assignee: Sulzer Brothers Limited, Winterthur, Switzerland

[21] Appl. No.: 849,685

[22] Filed: Apr. 9, 1986

[30] Foreign Application Priority Data

May 3, 1985 [EP] European Pat. Off. ..... 85-810201.5

[51] Int. Cl.[4] ..... D03D 49/66; D03D 47/27

[52] U.S. Cl. ..... 139/188 R; 139/439; 139/449

[58] Field of Search ..... 139/439, 188 R, 192, 139/449

[56] References Cited

U.S. PATENT DOCUMENTS 2,039,454 5/1936 Rossmann ..... 139/188 R 3,556,163 1/1971 Pfarrwaller ..... 139/188 R

FOREIGN PATENT DOCUMENTS 165326 12/1985 European Pat. Off. ..... 139/188 R 1083279 9/1967 United Kingdom ..... 139/188 R

*Primary Examiner*—Henry S. Jaudon

*Attorney, Agent, or Firm*—Kenyon & Kenyon

[57] ABSTRACT

The guide for a picking element is provided with five plane guide surfaces which are peripherally disposed about the picking tunnel. These five guide surfaces are disposed on each of the single guide tooth or are distributed between a separately constructed guide hook and an adjacent separately constructed guide support. Any two adjacent guide surfaces are disposed to define an angle of at least 90 degrees in order to reduce the friction forces operating between the guide surfaces and the picking element.

14 Claims, 11 Drawing Figures

Fig. 1
PRIOR ART
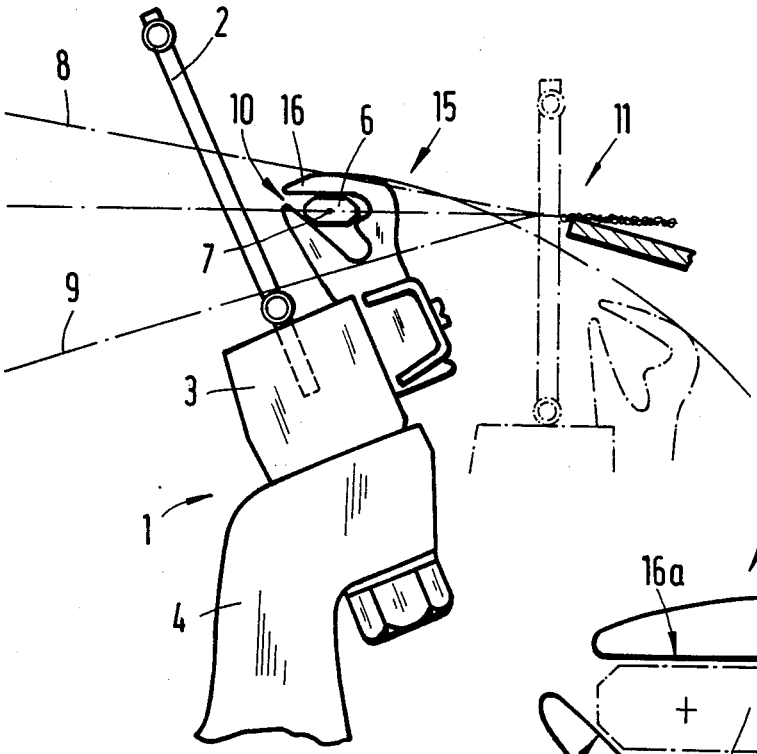
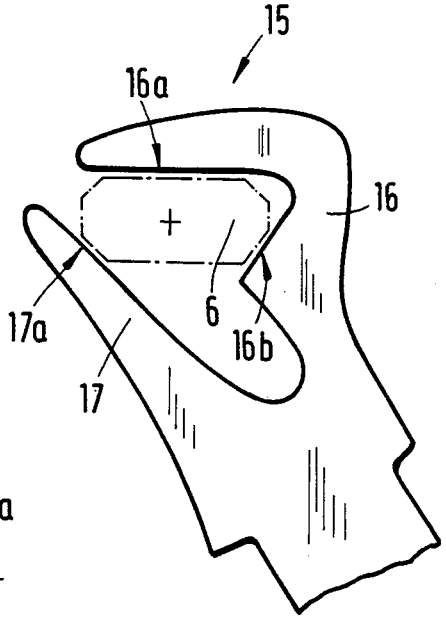
Fig. 2
PRIOR ART
Fig. 3
PRIOR ART
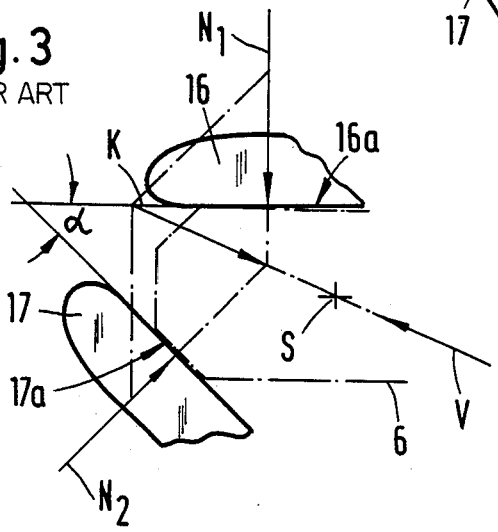

GUIDE FOR A PICKING ELEMENT IN A WEAVING MACHINE

This invention relates to a guide for a picking element in a weaving machine.

As is known, weaving machines have been provided with various types of guides for picking elements such as gripper projectiles, rods, and the like. In many cases, the guides have been constructed of aligned teeth which define a picking tunnel for the picking element and which have guide surfaces on which the picking element can be guided during picking. In addition, the guide teeth have been formed with an exit aperture to one side of the picking tunnel so as to permit a weft yarn to exit for beating-up into a cloth. In some cases, the guide teeth may be of identical construction, such as described in German Pat. No. 2,628,625 or the guide teeth may be formed by an alternating series of guide supports and guide hooks, such as described in Swiss Pat. No. 465,521.

Generally, the projectiles which have been guided have eight plane surfaces about the periphery with three of these surfaces being operative for guiding of the projectile through the picking tunnel of a guide. In a similar manner, the guide teeth have been provided with three guide surfaces for guiding of the projectile. Usually these guides have proved satisfactory in practice to the extent that the finished cloth, even cloth made to stringent quality specifications, is free from irregularities caused by the guide teeth. Further, the previously known guide teeth damage neither warp yarns nor weft yarns. However, it has been found that to avoid wear between the guide teeth and the picking element, an elaborate lubricating facility providing accurate metering of lubricant is necessary for the picking tunnel. Conventionally, the lubricant is injected into the tunnel by way of the picking element. However, disturbances in the lubrication system can lead to a lack of lubrication and wear of the guide teeth, the wear becoming apparent as soiling of the cloth.

Accordingly, it is an object of the invention to provide a guide for a picking element which is less prone to wear in the event of an insufficiency of lubrication.

It is another object of the invention to provide a guide for a picking element in which the wear due to friction between a picking element and the guide is reduced.

Briefly, the invention provides a guide for a picking element in a weaving machine which is comprised of a plurality of guide teeth having a plurality of peripherally disposed guide surfaces which define a picking tunnel for a picking element. In accordance with the invention, at least five of these surfaces are disposed to slidably contact a picking element during picking with any two peripherally adjacent guide surfaces forming an angle of at least 90 degrees therebetween. The guide teeth are also formed to define an exit aperture which communicates with the picking tunnel for passage of a picked weft yarn from the tunnel. The guide surfaces are arranged so that the surfaces on opposite sides of the exit aperture define an angle of 90 degrees therebetween.

The guide teeth may be of identical construction so that each guide tooth has five guide surfaces thereon. Alternatively, the guide teeth may be formed by an alternating series of guide supports and guide hooks wherein the five guide surfaces are distributed between an adjacent guide support and guide hook.

The guide surfaces of the guide teeth are disposed so as to act on the same number of surfaces on a picking element which passes through the guide and which are parallel to the guide surfaces during picking.

One advantage provided by the improved guide over previously known guides is that the improved shape leads to reduced guiding forces between the picking element and the guide. In a first approximation, the friction on the picking element is reduced to the same extent. This is a very important consideration for projectile weaving machines since the drop in projectile speed caused by friction when large cloth widths are being worked reduces the speed in which the machines can operate. Further, reducing the friction also enables a standby of lubricant in the weft tunnel to be reduced, again with advantages for attainable cloth quality. Thus, in some cases, a simple and relatively inexpensive lubricating system may be satisfactory.

These and other objects and advantages of the invention will become apparent from the following detailed description taken in conjunction with the accompanying drawings wherein;

FIG. 1 illustrates a view in a picking direction of a previously known guide for a picking element;

FIG. 2 illustrates an enlarged view of a guide tooth of the known guide;

FIG. 3 illustrates the force relationships between a picking element and a guide tooth of a previously known guide;

Figure 4:
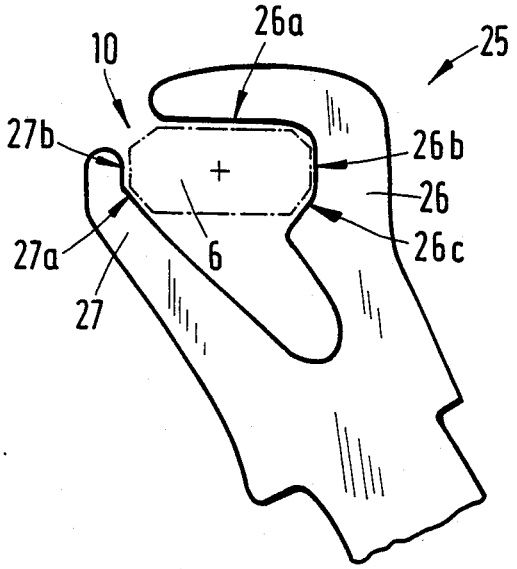
FIG. 4 illustrates a view of a guide tooth constructed in accord with the invention.

Referring to FIG. 1, the weaving machine includes a sley 1 which carries a reed 2 via a sley section 3 on a sley lever 4 which is disposed on an oscillation shaft (not shown) which oscillates about a pivot axis (not shown). In addition, a guide for a picking element 6, for example in the form of a gripper projectile, is mounted on the sley section 3. As indicated the guide is formed of a plurality of aligned teeth 15 which are disposed at regular intervals along the sley section 3 and define a weft tunnel for the projectile 6 for the picking of a weft yarn 7 into a shed formed by warp yarns in the warp planes 8,9. After picking, the teeth 15 descend to the right, as viewed, the leave the shed with the weft 7 issuing to the left, as viewed, through a funnel-shaped opening 10 in the teeth 15. Subsequently, with the sley 1 in the chain-dotted-line position in FIG. 1, the weft yarn 7 is beaten up into a cloth 11.

The construction of the weaving machine is generally known and need not be described.

Referring to FIG. 2, each guide tooth 15 has a guide hook 16 having guide surfaces 16*a*, 16*b* and an opposite side support 17 with a guide surface 17*a* for guiding the picking element 6 thereon. As indicated, the guide element 6 has a total of eight plane surfaces about the periphery of which three can contact the guide surfaces 16*a*, 16*b*, 17*a* of the tooth 15 during picking.

Referring to FIG. 3, during picking, the picking element 6 does not normally fly dead parallel to the weft tunnel or path defined by the guide teeth 15 but moves with a component perpendicular to the weft picking direction at a particular speed V. As a result, a collision takes place between the picking element and, for example, the guide surfaces 16*a*, 17*a* during flight of the picking element. The direction and magnitude of the speed V are different from one collision to another and depend on various influences.

In the known construction, the top guide surface 16*a* of the guide tooth cooperates with a guide surface 17*a* to include an angle $\alpha$ of 45 degrees. When the picking element 6 moves at the speed V parallel to the bisector of the angle $\alpha$ towards the guide surfaces, 16*a*, 17*a*, the resulting collision gives rise to an impact force K which hurls the picking element 6 back in the opposite direction. Of note, it is assumed in this example that the picking element moves purely in translation. In fact, there is also an oscillating rotation of the picking element around the longitudinal axis. However, the effect of this rotation on the reaction forces applied by the guide surfaces to the picking element will be neglected.

The resulting impact force K acting on the picking element is applied thereto by way of the guide surfaces 16*a*, 17*a* by the major forces $N_1$ and $N_2$ which in the example under consideration are equal. It can readily be determined graphically or numerically that, in the most unfavourable case considered of a collision between the picking element and the guide tooth, the sum of the normal forces $N_1$, $N_2$ is 2.61 times the force K. The friction forces operative to brake the picking element on the surfaces 16*a*, 17*a* are, in a first approximation, proportional to the forces $N_1$, $N_2$ and depend upon the surface condition of the surfaces and upon the lubricant in between.

When the picking element 6 moves towards the guide surface 16*a* perpendicularly thereto, the force $N_1$ is the same as the impact force K. Correspondingly, in a first approximation, the friction experienced by the projectile is 2.61 times less than in the example just considered.

In the event of the picking element 6 colliding simultaneously with the surfaces 16*a*, 16*b* (FIG. 2) the force conditions arising in the case shown in FIG. 3 will be comparable.

Referring to FIG. 4, the guide for the picking element which is constructed in accordance with the invention includes guide teeth 25 each of which have a plurality of peripherally disposed guide surfaces defining a picking tunnel for the picking element 6 as well as an exit aperture 10. In this case, each guide tooth 25 has five consecutive plane guide surfaces 26*a*, 26*b*, 26*c*, 27*a*, 27*b* disposed on the respective guide hook 26 and guide support 27. The guide surfaces are arranged so that any two peripherally adjacent surfaces form an angle of at least 90 degrees therebetween. As illustrated, the surfaces 26*a*, 26*b*, define an angle of 90 degrees, the surfaces 26*c*, 27*a* define an angle of 90 degrees and the surfaces 27*b*, 26*a* on opposite sides of the exit aperture 10 also define an angle of 90 degrees therebetween. The angle between the guide surfaces 26*b*, 26*c* and 27*a*, 27*b* is 135 degrees. However, the inclinations of the surfaces 27*a*, 26*c* can be such that the angles between the pairs of surfaces 27*a* and 27*b*, 27*a* and 26*c*, 26*b* and 26*c* are all 120 degrees.

Figure 5:
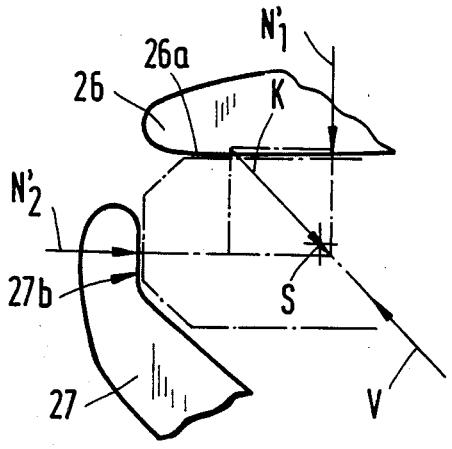
FIG. 5 illustrates the force relationships between a picking element and a guide tooth constructed in accordance with the invention.

FIG. 5 illustrates a diagram of forces for the worst case as regards friction of a collision between the picking element and a guide tooth 25. As indicated, the vector V for the speed and the vector K for the reaction impact force are disposed parallel to the bisector of the angle between the surfaces 27*b* and 26*a* which is at an angle of 45 degrees to the horizontal. In this case, the sum of the forces $N'_1$ and $N'_2$ is only 1.41 times greater than the force K. The friction forces are, in this case, also proportional to $N'_1$ and $N'_2$. A comparison between the force diagram associated with the prior art (FIG. 3) and the invention (FIG. 5) shows that the ratio of the sums of the friction forces is the quotient of 2.61 divided by 1.41—i.e. 1.85. In a prior art construction, therefore, the friction opportive between the picking element and the guide is 1.85 times greater than in a guide according to the invention.

As can be seen from FIG. 4, two of these surfaces, i.e. 26*c*, 27*a*, are angularly disposed on opposite sides of the plane bisecting the angle defined between the two surfaces while the surface 26*a* is disposed transversely to that plane with the surfaces 26*b*, 27*b* disposed parallel to and on opposite sides of that plane. Further, the surfaces, 26*c*, 27*a* may also be angularly disposed to define an angle of from 120 degrees to 135 degrees.

Of note, the five guide surfaces are disposed relative to the picking element 6 passing therebetween so as to permit simultaneous contact with the picking element 6 with at most two adjacent guide surfaces.

Figure 6:
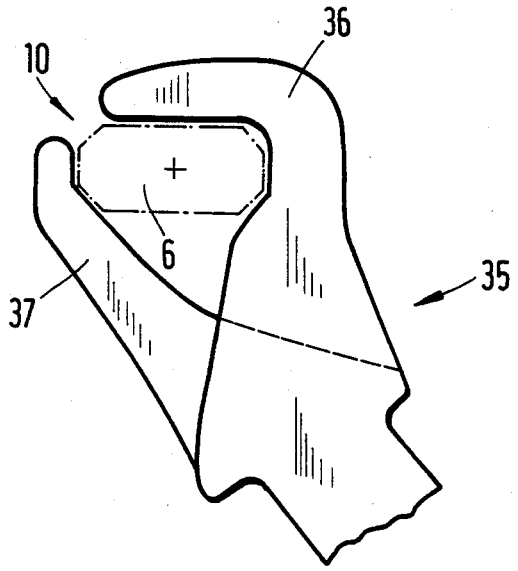
FIG. 6 illustrates a modified guide employing an alternating series of guide supports and guide hooks.
Figure 10:
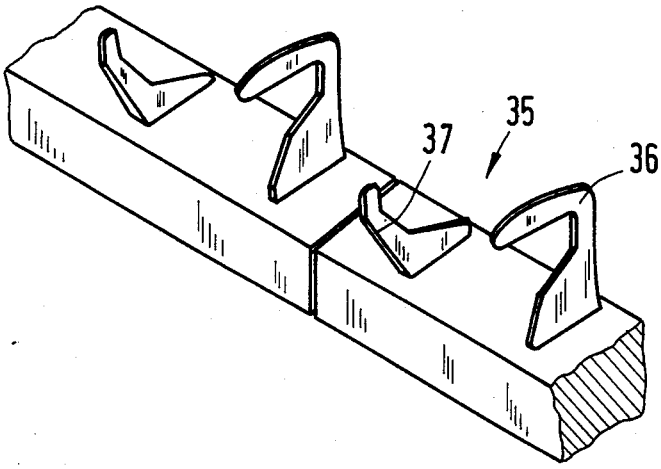
FIG. 10 illustrates a part perspective view of a guide employing guide teeth as shown in FIG. 6.

Referring to FIGS. 6 and 10, the guide may alternatively be constructed of a plurality of longitudnially aligned and spaced guide supports 37 and guide hooks 36 which are disposed in alternating relation with the guide supports 37. As indicated in FIG. 6, a guide hook 36 and an adjacent guide support 37 define a guide tooth 35.

As further indicated in FIG. 6, each guide support 37 has two guide surfaces for contacting a picking element 6 passing thereby while each guide hook 36 has three plane guide surfaces for contacting the picking element 6.

Figure 7:
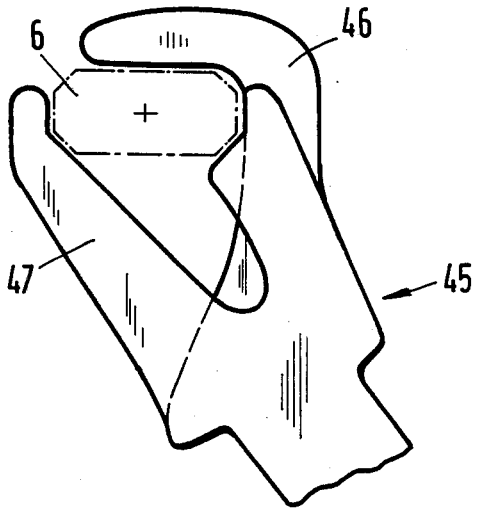
FIG. 7 illustrates a view similar to FIG. 6 of a further modified guide tooth arrangement having separate guide supports and guide hooks.
Figure 11:
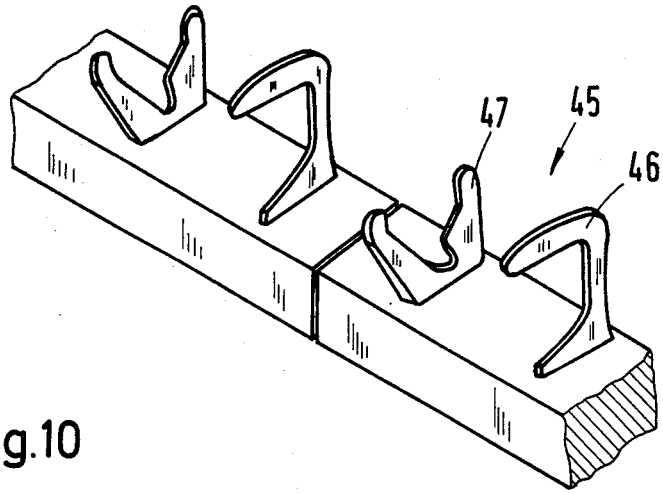
FIG. 11 illustrates a part perspective of a guide employing guide teeth as shown in FIG. 7.

Referring to FIGS. 7 and 11, the guide may also be constructed in a manner to distribute the five guide surfaces for a picking element 6 in a different distribution. For example, where the guide is formed of an alternating series of guide hooks 46 and guide supports 47, each guide hook 46 may provide two of the guide surfaces while each guide support has two arms providing three or four guide surfaces. In this respect, one of the guide surfaces on a guide hook is coplanar with one of the guide surfaces of the adjacent guide support 47.

Figure 8:
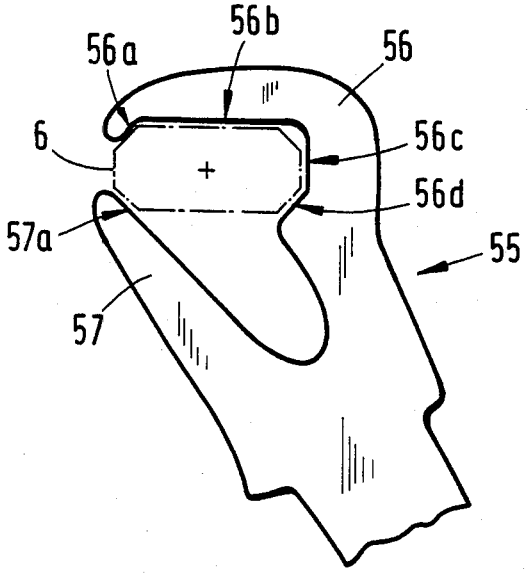
FIG. 8 illustrates a view of a modified guide tooth in accordance with the invention.

Referring FIG. 8, a guide to 55 may be constructed so that the guidehook 56 has four guide surfaces 56*a*, 56*b*, 56*c*, 56*d* for the picking element 6, whereas the guide support 57 has only a single guide surface 57*a*.

Figure 9:
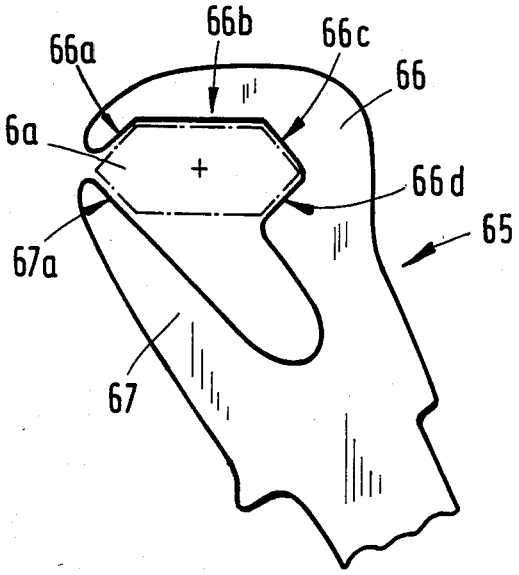
FIG. 9 illustrates a further modified guide tooth for a picking element having six peripheral surfaces.

Referring to FIG. 9, where the picking elements 6*a* is of a different shape, for example having six plane surfaces, the guide to 65 may have a guidehook 66 defining four guide surfaces 66*a*, 66*b*, 66*c*, 66*d* while a guide support 67 as a single guide surface 67*a*. In this case, since the picking element 6*a* does not have any vertical surfaces, as viewed, the guide to 65 does not have any vertical guide surfaces. Instead, as shown, four of the guide surfaces are at angles of 45 degrees to the horizontal while the remaining surface 66b is horizontal.

One important consideration for the guide embodiment described above is that the distances of the guide surfaces from the picking element must be such that in the event the picking element shifts in the weft without additional rotation, there can be contact or at most, two adjacent guide surfaces at a time.

In all of the described embodiment the arrangement of the guide surfaces and of the gaps therebetween insures that warp yarns and weft yarns are not damaged when the guide enters and leaves a shed.

The invention thus provides a guide for a picking element in which the picking element may be guided with reduced friction through the guide. As a result, the life of the guide can be extended. Further, the amount of lubrication or coolant which may be required to reduce any heat generated during picking can be reduced to a minimum.

What is claimed:

1. A guide for a picking element in a weaving machine comprising a plurality of guide teeth having a plurality of peripherally disposed plane guide surfaces defining a picking tunnel for a picking element, at least five of said surfaces being disposed to slidably contact a picking element during picking with any two peripherally adjacent guide surfaces forming an angle of at least 90 degrees therebetween, two of said five surfaces being disposed in parallel and two other of said five surfaces adjacent said parallel surfaces being in perpendicular relation to each other.

2. A guide as set forth in claim 1 wherein said guide teeth include an alternating series of guide supports and guide hooks, each said guide support having at least one of said five surfaces thereon and each said guide hook having the remainder of said five surfaces therein.

3. A guide for a picking element in a weaving machine comprising a plurality of longitudinally aligned and spaced apart guide teeth defining a picking tunnel for a picking element and an exit aperture communicating with said picking tunnel for passage of a picked weft yarn from said tunnel, each said guide tooth having at least five plane guide surfaces peripherally disposed about said tunnel for guiding complementary parallel surfaces of a picking element thereon, each said pair of adjacent guide surfaces forming an angle of at least 90 degrees therebetween, two of said five surfaces being disposed in parallel and two other of said five surfaces adjacent said parallel surfaces being in perpendicular relation to each other.

4. A guide as set forth in claim 3 wherein said guide surfaces on oppostie sides of said exit aperture define an angle of 90 degrees therebetween.

5. A guide as set forth in claim 3 wherein a first two of said surfaces are angularly disposed on opposide sides of a plane bisecting the angle defined between said two surfaces, one of said surfaces is disposed transversely to said plane and a second two of said surfaces are disposed parallel to and on opposite sides of said plane.

6. A guide as set forth in claim 5 wherein said first two of said surfaces are angularly disposed to define an angle of from 120 degrees to 135 degrees therebetween.

7. A guide as set forth in claim 3 wherein a first two of said surfaces are angularly disposed on opposite sides of a plane bisecting the angle defined between said two surfaces, one of said surfaces is disposed transversely to said plane and a second two of said surfaces are disposed angularly of and on opposite sides of said plane, each surface of said second two of said surfaces forming an angle of 90 degrees with a respective surface of said first two of said surfaces.

8. A guide as set forth in claim 3 wherein a first two of said surfaces are angularly disposed on opposite sides of a plane bisecting the angle defined between said two surfaces, one of said surfaces is disposed transversely to said plane and a second two of said surfaces are disposed on opposite sides of said plane.

9. A guide as set forth in claim 3 wherein said guide surfaces are disposed relative to a picking element passing therebetween to permit simultaneous contact of the picking element with at most two adjacent guide surfaces.

10. A guide for a picking element in a weaving machine comprising a plurality of longitudinally aligned and spaced guide supports having at least two plane guide surfaces thereon for contacting a picking element passing thereby;

a plurality of guide hooks disposed in alternating relation with said guide supports to define a picking tunnel for a picking element and an exit aperture communicating with said tunnel for passage of a picking weft yarn from said tunnel, each said hook having at least two plane guide surfaces thereon for contacting a picking element passing thereby; and wherein each adjacent guide support and guide hook define five plane guide surfaces peripherally about said tunnel for guiding complementary parallel surfaces of a picking element thereon, each said pair of peripherally adjacent guide surfaces forming an angle of at least 90 degrees therebetween, two of said five surfaces being disposed in parallel and two other of said five surfaces adjacent said parallel surfaces being in perpendicular relation to each other.

11. A guide as set forth in claim 10 wherein said guide surfaces on opposite sides of said exit aperture define an angle of 90 degrees therebetween.

12. A guide as set forth in claim 10 wherein a first two of said surfaces are angularly disposed on opposite sides of a plane bisecting the angle defined between said two surfaces, one of said surfaces is disposed transversely to said plane and a second two of said surfaces are disposed on opposite sides of said plane.

13. A guide as set forth in claim 10 wherein each guide support has two of said five surfaces thereon and each guide hook has three of said five surfaces thereon.

14. A guide as set forth in claim 10 wherein each guide support has four of said five surfaces thereon and each guide hook has two of said five surfaces thereon with one of said two surfaces being coplanar with one of said surfaces of an adjacent guide support.

* * * * *